US005971335A

United States Patent [19]

Perrin et al.

[11] Patent Number: 5,971,335

[45] **Date of Patent: *Oct. 26, 1999**

[54] HOLDER FOR DISPENSING CONTAINERS

[75] Inventors: Patrick C. Perrin, Rancho Palos Verdes; Richard C. Fisk, Granada Hills, both of Calif.

[73] Assignee: Perrin Manufacturing Company, City of Industry, Calif.

[ * ] Notice: This patent is subject to a terminal disclaimer.

[21] Appl. No.: 09/002,879

[22] Filed: Jan. 5, 1998

Related U.S. Application Data

[63] Continuation of application No. 08/675,726, Jul. 3, 1996, Pat. No. 5,758,853.

[51] Int. Cl.[6] ..... A47K 1/08

[52] U.S. Cl. ..... 248/311.2

[58] Field of Search ..... 248/311.2, 311.3, 248/312.1, 313, 314, 316.8, 300, 312; 222/179, 180, 181.3

[56] References Cited

U.S. PATENT DOCUMENTS

| | | | |
|---|---|---|---|
| D. 274,214 | 6/1984 | DeVos | D8/373 |
| D. 274,786 | 7/1984 | DeVos | D8/373 |
| 3,627,248 | 12/1971 | Nelson | 248/309 |
| 3,872,868 | 3/1975 | Kline | 128/272 |
| 3,964,709 | 6/1976 | LaBelle et al. | 248/311.2 |
| 5,406,448 | 4/1995 | Anderson et al. | 248/300 X |
| 5,624,043 | 4/1997 | Baptista | 211/74 |

FOREIGN PATENT DOCUMENTS

| | | | |
|---|---|---|---|
| 512614 | 11/1992 | European Pat. Off. | 248/300 |

*Primary Examiner*—Ramon O. Ramirez
*Attorney, Agent, or Firm*—Sheldon & Mak

[57] ABSTRACT

A bracket for liquid dispensing containers has a back, a base, and a top projecting laterally from the back for holding the bottom and top, respectively, of the dispensing container. The bracket and top are skewed relative to the plane of the back a sufficient amount that when the bracket is mounted on a vertical surface, the container top is farther away from the mounting surface than is the container bottom to prevent liquid from dripping onto the container or the bracket.

29 Claims, 2 Drawing Sheets

HOLDER FOR DISPENSING CONTAINERS

CROSS-REFERENCE

This application is a continuation of our utility patent application, Ser. No. 08/675,726, filed Jul. 3, 1996 now U.S. Pat. No. 5,758,853, and entitled HOLDER FOR DISPENSING CONTAINERS. That application is incorporated herein by reference.

BACKGROUND

The present application is directed to holders for dispensing containers.

Dispensing containers such as those used for liquid soap, dishwashing soap, and other liquids are becoming popular with consumers. Dispensing containers typically have a pump action top. An advantage of dispensing containers is that a user does not come in direct contact with the contents of the containers. For example, a bar of soap is contacted by every user, while liquid soap in a dispensing container is not. This makes the use of dispensing containers in such settings as restaurants and hospitals particularly desirable.

There are problems associated with dispensing containers that have limited their use. One problem is they take up valuable counter space. Another problem is that they can add to the expense of a product, i.e., a container of liquid soap is more expensive than a bar of soap. Further, dispensing containers are easily portable. Thus, their use in commercial environments such as restaurants or healthcare institutes has been limited because they can easily "disappear".

Accordingly, it would be desirable to be able to mount dispensing containers on a vertical surface, in such a way that the dispensing action is not lost. Moreover, it is desirable that the mounting mechanism be easy to use, securely hold the dispensing container, and be inexpensive. Further, it is desirable that any such mounting mechanism not easily become fouled with splattered liquid and drips from the container.

SUMMARY

The present invention is directed to a bracket, also referred to as a holder, that satisfies these needs. The bracket is specially designed for holding dispensing containers, which typically comprise a bottom, side walls, and a top. The top typically is provided with a dispensing arm that extends laterally from the front, the dispensing arm having a dispensing hole for dispensing liquid.

The holder comprises a back, a base and a top. The base and the top both project laterally from the back, and are vertically spaced apart from each other. The back is provided with means, such as screw holes, for securing the back to a mounting surface.

The base, and preferably the top, are skewed relative to the plane of the holder a sufficient amount that when the back is vertical and the container is in the holder, the container top is farther away from the back than is the container bottom. Typically the skewing is from about 10 to 30° away from perpendicular to the plane of the back, and preferably about 20°. This skewing allows the dispensing hole and dispensing arm to be sufficiently distant from the back so that any liquid dripping from the dispensing hole does not drip on the container or the holder base. In other words, the container is held secured relative to the vertical mounting surface so that the top of the container is farther away from the mounting surface than is the bottom, so that any drippage misses both the bracket and the side walls of the container.

Preferably the bottom of the base is flat so that the bracket can also be used to hold a container on a flat surface without mounting on a wall.

Preferably the base has means for retaining the container bottom thereon, such as a projection that engages a detent in the bottom of the container.

The projection has a front face, a top face, and a rear face. Preferably, the rear face projects from the base more than the front face to facilitate placement of the container in the holder. Similarly, preferably the top front edge of the base is chamfered or radiused to facilitate placement of the container in the holder.

Preferably the holder top is provided with means for holding the container top in the holder. This can be as simple as an aperture in the container top through which the container top can project when the container is mounted on the base.

The holder can have an integral monocoque construction, such as by being injected molded of a material such as acrylic. For ease of manufacture and ease of use, preferably the holder has no moving parts. Preferably the holder is of open construction so that any labelling on the front of the container is unobstructed.

DRAWINGS

These and other features, aspects and advantages of the present invention will become better understood from the following description, appended claims, and accompanying drawings where:

DESCRIPTION

Figure 1:
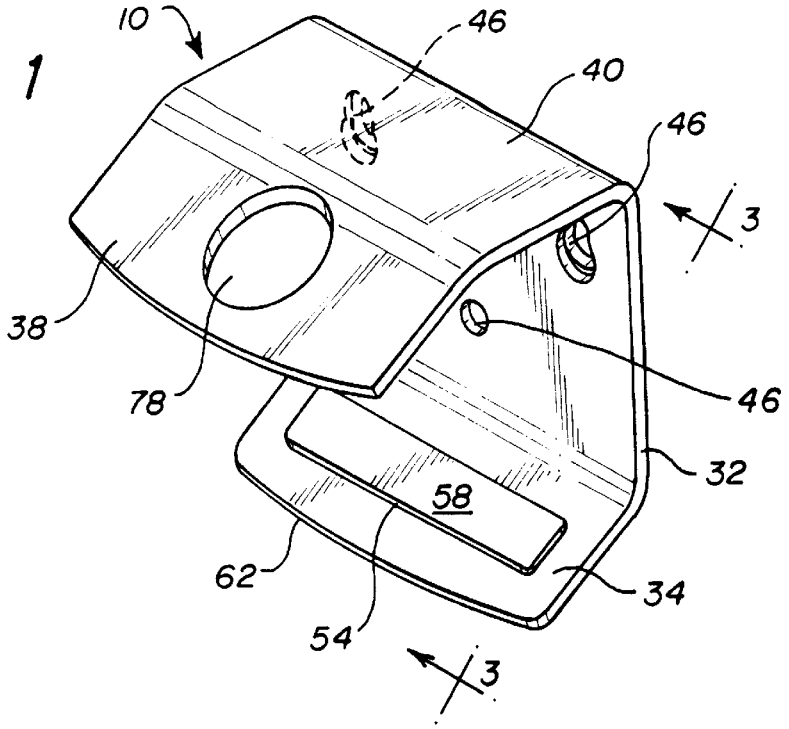
FIG. 1 is a perspective view of a bracket according to the present invention, with one of the mounting holes shown in phantom.
Figure 2:
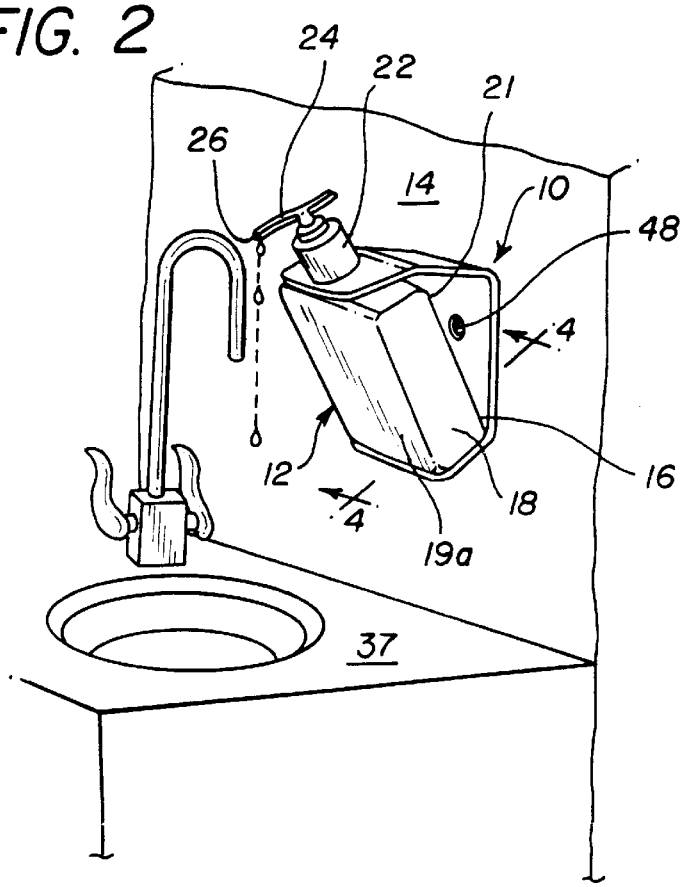
FIG. 2 is a perspective view of the bracket of FIG. 1 mounted on a wall, and holding a container.

A bracket or holder 10 according to the present invention, is as shown in the figures. The bracket 10 is useful for holding a dispensing container 12 on a substantially vertically oriented mounting surface 14 such as a bathroom wall, shower wall, bathtub, door, or side wall of a medicine cabinet.

The dispensing container 12 is typical of the type of the containers that can be held by the bracket 10, but use of the bracket is not limited to such dispensing containers. The dispensing container 12 shown in the figures is the type of containers commercially available for dispensing liquid under the trademark DIAL. The container 12 has a bottom wall 16, side walls 18, a front wall 19*a* on which a label can be provided, a rear wall 21 on which a label can be provided, and a top 22. A dispensing arm 24 projects laterally from the top 22. The dispensing arm 24 and top 22 provide a pumping mechanism for pumping liquid out of the container 12 by pushing downwardly on the top 22. The liquid passes out of a dispensing aperture 26 in the end of the dispensing arm 24.

Figure 3:
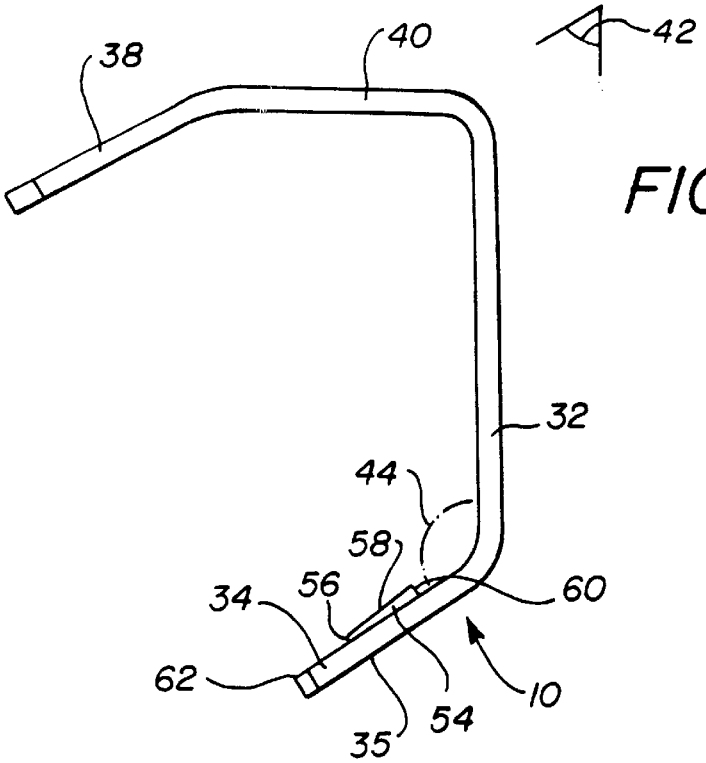
FIG. 3 is a side elevation view of the bracket of FIG. 1 taken on line 3—3 in FIG. 1.

The bracket 10 comprises a back 32 and a base 34 projecting outwardly from the bottom of the back 32 at a fixed angle. The bottom 35 of the base 34 is substantially flat so that the bracket 10 can hold the container 12 on a horizontal surface such as a counter 37. A top 38 projects from the top of the back 32 and is connected to the back by an extension segment 40. Although the extension segment 40 is substantially perpendicular to the plane of the back 32, preferably the base 34 and preferably the top 38 are skewed relative to the plane of the back 32. Both are skewed relative to the plane of the back by similar amounts, typically from about 10 to about 30° away from being perpendicular, and preferably about 20°. In other words, the angle between the plane of the top 38 and plane of the back 32, as represented by angle 42 in FIG. 3, is from about 10 to about 30°, and preferably about 20° less than perpendicular, i.e., from 60 to 80°. Similarly, the angle between the plane of the back 32 and the plane of the base 34 as represented by angle 44 in FIG. 3, is from 10 to 30° greater than perpendicular (i.e., from 100 to 130°), and typically about 20° greater than perpendicular (about 110°). Thus, both the base 34 and the top 38 extend downwardly relative to the back 32 and the mounting surface 14 when the bracket 10 is secured to the mounting surface 14.

The purpose of the skewing is to prevent liquid dispensed from the dispensing aperture 26 from dripping onto either the bracket 10 or the container 12. Accordingly, the amount of skewing is selected and the extension segment 40 is sized so that the dispensing arm 24 extends beyond the front wall of the container. The dispensing arm also extends beyond the front edge of the top of the holder by about 0.75 to about 1.25 inches.

Preferably the top 38 is skewed slightly more than the base 34, typically 1 to 2 degrees, to provide pre-tension loading.

A further advantage of having the dispensing arm 24 projecting forwardly relative to the container is that this gives an appearance "inviting" use of the dispensing container 12.

Means are provided for securing the back 32 to the mounting surface 14. The securing means can be any mechanism currently used or used hereafter for securing a bracket to a vertical surface, including adhesive, double-sided adhesive tape, glue, and openings for fasteners, such as nails, screws, and the like. As shown in FIG. 1, a preferred mechanism is three holes 46, two of which are slotted, through which mounting screws 48 can be provided. Another option for the securing means is hook and loop type fasteners, such as the type sold under the trademark Velcro, where one portion of the fastener is secured to the wall and the other portion is secured to the back 32.

It is desirable that the base 34 be provided with means for retaining the container 12 in the bracket 10. It is desirable that the retaining means allow the container to be easily placed into the bracket 10 and easily removed therefrom. A preferred mechanism is by having a detent 52 in the bottom wall 16 of the container 12, with a projection 54 on the base 34. The projection 54 is sized and located to engage the detent 52. The projection 54 has a front wall 56, a top surface 58, and a rear wall 60. Preferably the front wall 56 of the projection is shorter than the rear wall 60, as shown in FIG. 3, so that the top surface 58 slopes downwardly towards the front of the bracket 10. This facilitates placement of the container 12 in the bracket 10. Similarly, the top edge 62 of the front of the bracket base 34 can be chamfered to facilitate placement of the container 12 in the bracket 10.

Although the projection 54 is shown as a continuous element in the figures, there can be separate multiple projections projecting into the detent 52.

Mechanisms other than the projection 54 can be used as the retaining means. For example, a tacky adhesive can be provided on the base. Similarly, the base 34 can be provided with one-half of a hook and loop fastener, such as Velcro™ fastener, and the other half of the hook and loop fastener can be secured to the bottom 16 of the container 12. Another retaining means that can be used are projections on the container bottom 16 that can project into a detent in the base 34. Similarly, the base 34 can have a recess that matches the cross-sectional configuration of the bottom 16 of the container 12, into which the bottom 16 of the container 12 can be seated.

Figure 4:
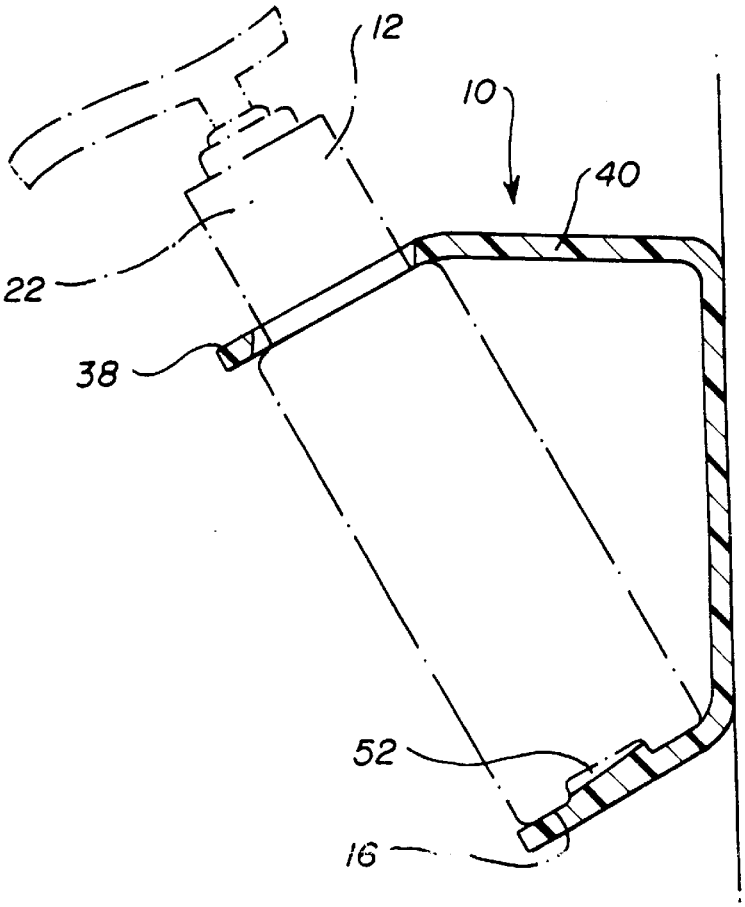
FIG. 4 is a sectional view of the bracket of FIG. 1, taken on line 4—4 in FIG. 2, showing how the container is held in place by the holder.

The bracket top 38 is provided with means for retaining the container top 22. Any of the mechanisms used for the retaining means on the base 34 can be used. A preferred retaining means for the top 38 is an aperture 78 through the bracket top 38, through which the container top 22 extends, with the dispensing arm 24 positioned at a greater elevation than is the bracket top 38. Preferably the aperture is slightly elliptical, and as shown in FIG. 4, is slightly skewed relative to the plane of the bracket top.

The spacing between the base 34 and top 38 of the bracket 10 is selected to accommodate the vertical extent of the container 12. They can spaced further apart to accommodate containers sized larger than the container 12 shown in the drawings.

Preferably the bracket 10 is of integral, monocoque construction with no moving parts. This allows the device to be inexpensively manufactured. A preferred method for manufacture is injection molding out of a polymeric material suitable for injection molding, such as acrylic. Advantages of acrylic are that it is inexpensive, easily injection molded, and is available as a substantially transparent material, which gives the container held in the bracket 10 a desirable appearance of "floating in air". It can also be injection molded out of polystyrene, polycarbonate, polysulfones and the like.

Instead of injection molding the bracket, it can be heat formed from sheet plastics such as acrylic and ABS, or can be prepared from metals such as sheet steel and sheet aluminum. The bracket 10 can also be formed out of wood or wood substitutes.

An advantage of the bracket 10 is that it is "open", i.e., there is nothing to obstruct the view of the front of the container 12. Thus, any labelling and advertising material on the front of the container are unobstructed.

Other advantages of the bracket 10 are that it is inexpensive to manufacture, easy to hang on a wall, easy to use, and provides the perception that the dispensing container is secured or "locked" into the bracket, thus deterring theft. Moreover, it maintains the dispensing container on the wall, thus freeing up counter space. Moreover, by use of the bracket messy drips onto either the bracket or the dispensing container are avoided. Further, it is designed so that it can sit on the counter, thus providing the option of holding the dispensing container on a horizontal surface, such as a counter, when a suitable vertical surface is unavailable.

Although the present invention has been described in considerable detail with reference to certain preferred versions thereof, other versions are possible. Therefore, the scope of the appended claims should not be limited to the description of the preferred versions contained herein.

What is claimed is:

1. A dispensing system comprising a pumpable dispensing container and a holder supported by a horizontal surface, the dispensing container comprising: (i) a body having a bottom and a top, and (ii) a dispensing mechanism at the top;

the holder comprising:

(i) a back;

(ii) a base supported by the horizontal surface and supporting the bottom of the container body with the container top at a higher elevation than the container bottom, the base projecting laterally from the back of the holder, wherein the holder base is skewed relative to the plane of the holder back a sufficient amount that the container top is farther away from the back than is the container bottom; and (iii) a top vertically spaced apart and above the base and projecting laterally from the back of the holder, the top of the holder engaging the container top with a portion of the container above the holder top, such that the holder does not interfere with the pumping of the dispensing mechanism and sufficiently supports the container so that the dispensing mechanism can be pumped.

2. The holder of claim 1 wherein the holder top is skewed relative to the plane of the holder by about the same amount as is the holder base.

3. The holder of claim 1 wherein the container bottom and the holder base each has a plurality of surfaces for maintaining the container bottom and the holder base in contact with each other.

4. The holder of claim 1 wherein the holder base has a front top edge, the front top edge being chamfered to facilitate placement of the container in the holder.

5. The holder of claim 1 wherein the holder is of integral monocoque construction.

6. The holder of claim 1 wherein the holder base and top are skewed relative to the plane of the holder back by about 10 to about 30 degrees.

7. A mounted dispensing system comprising a holder and a pumpable dispensing container in combination, the dispensing container comprising:

(i) a body having a bottom and a top, and (ii) a dispensing mechanism at the top;

the holder comprising:

(i) a back;

(ii) a base supporting the bottom of the container body with the container top at a higher elevation than the container bottom, the base projecting laterally from the back of the holder, wherein the holder base is skewed relative to the plane of the holder back a sufficient amount that the container top is farther away from the holder back than is the container bottom;

(iii) a top vertically spaced apart and above the base and projecting laterally from the back of the holder, the top of the holder securely engaging the container body; and (iv) means mounting the holder back to a vertical surface.

8. The system of claim 7 wherein said mounting means comprises at least one aperture in the holder back and a fastener passing through the aperture and the surface.

9. The system of claim 7 wherein the holder top is skewed relative to the plane of the holder by about the same amount as is the holder base.

10. The system of claim 7 wherein the dispensing mechanism extends laterally from the container top and has a dispensing hole, and wherein the holder base is skewed relative to the plane of holder back a sufficient amount that when the plane of the back is vertical, the dispensing hole is sufficiently distant from the vertical surface that liquid dripping from the dispensing hole does not drip on the container or the holder base.

11. The system of claim 7 wherein the holder base and the container bottom each has a plurality of surfaces to facilitate maintaining contact between the holder base and the container bottom.

12. A dispensing system comprising:

(A) a dispensing container comprising (i) a body having a bottom and a top, (ii) a detent in the container bottom, and (iii) a dispensing mechanism at the top; and (B) a holder supporting the container, the holder comprising:

(i) a back;

(ii) a base supporting the bottom of the container body with the container top at a higher elevation than the container bottom, the base projecting laterally from the back of the holder, wherein the holder base has one or more projections engaging the detent of the container for retaining the container in the holder; and (iii) a top vertically spaced apart and above the base and projecting laterally from the back of the holder and engaging the container top, with a portion of the container being above the holder top.

13. The system of claim 12 wherein the holder top and the holder base are skewed relative to the plane of the holder back by about the same amount.

14. The system of claim 12 wherein the holder base and the container bottom each has a plurality of surfaces.

15. The system of claim 12 wherein the holder base has a front top edge, the front top edge being chamfered to facilitate placement of the container in the holder.

16. A holder for a dispensing container, the dispensing container comprising (i) a bottom, (ii) a top, (iii) a dispensing mechanism extending away from the container top, (iv) a dispensing hole in the dispensing mechanism, and (v) a detent in the container bottom the holder comprising:

(a) a back;

(b) means mounting the back to a vertical mounting surface;

(c) a base projecting laterally from the back, the base supporting the bottom of the container and sized approximately equal to the bottom of the container;

(d) a projection on one of the holder base and container bottom projecting into one of the container bottom and holder base for retaining the container on the holder;

(e) a top vertically spaced apart from the base and projecting laterally from the back, the holder top having an aperture enclosed around its periphery through which the container top projects; and wherein the holder base and top are skewed relative to the plane of the holder back a sufficient amount that the container top is farther away from the mounting surface so that liquid dripping from the dispensing hole does not drip on the container or the holder base.

17. The holder of claim 16, wherein the holder base and top are skewed relative to the plane of the holder back by about 10 to about 30 degrees.

18. The holder of claim 16, wherein the projection has a front face, a top face, a rear face, and wherein the front face projects from the base less distance than does the rear face to facilitate placement of the container in the holder.

19. A holder for a pumpable dispensing container, the dispensing container comprising: (i) a body having a bottom and a top, and (ii) a dispensing mechanism at the top;

the holder comprising:

(i) a back;

(ii) a base for supporting the bottom of the container body with the container top at a higher elevation than the container bottom, the base projecting laterally from the back of the holder, wherein the holder base is skewed relative to the plane of the holder back a sufficient amount that the container top is farther away from the back than is the container bottom when the back is vertical; and (iii) a top vertically spaced apart and above the base and projecting laterally from the back of the holder, the top of the holder having an aperture enclosed around its periphery and sized so that a portion of the container body can pass transversely through the plane of the aperture, such that the holder does not interfere with the pumping of the dispensing mechanism and sufficiently supports the container so that the dispensing mechanism can be pumped, wherein the container bottom and the holder base each has a plurality of surfaces for maintaining the container bottom and the holder base in contact with each other.

20. The holder of claim 19 wherein the holder base and top are skewed relative to the plane of the holder back by about 10 to about 30 degrees.

21. A holder for a pumpable dispensing container, the dispensing container comprising: (i) a body having a bottom and a top, and (ii) a dispensing mechanism at the top;

the holder comprising:

(i) a back:

(ii) a base supporting the bottom of the container body with the container top at a higher elevation than the container bottom, the base projecting laterally from the back of the holder, wherein the holder base is skewed relative to the plane of the holder back a sufficient amount that the container top is farther away from the holder back than is the container bottom;

(iii) a top vertically spaced apart and above the base and projecting laterally from the back of the holder, the top of the holder having an aperture to secure the container body; and (iv) means mounting the holder back to a surface, wherein the holder base and the container bottom each has a plurality of surfaces to facilitate maintaining contact between the holder base and the container bottom.

22. A dispensing system comprising:

(A) a dispensing container comprising (i) a body having a bottom and a top, and (ii) a dispensing mechanism at the top; and (B) a holder supporting the container, the holder comprising:

(i) a back;

(ii) a base supporting the bottom of the container body with the container top at a higher elevation than the container bottom, the base projecting laterally from the back of the holder, wherein the holder base is skewed relative to the plane of the holder back a sufficient amount that the container top is farther away from the back than is the container bottom, and wherein the holder base is as large as the container bottom and adapted to maintain contact between the holder base and the container bottom; and (iii) a top vertically spaced apart and above the base and projecting laterally from the back of the holder, wherein the holder base and the container bottom each has a plurality of surfaces.

23. The system of claim 22 wherein the holder top is skewed relative to the plane of the holder by about the same amount as is the holder base.

24. The holder of claim 23 wherein the holder base and the holder back are oriented so that the top of the container is farther away from the container back than is the container bottom when the holder base is supported by a horizontal surface.

25. A holder for a container, the container comprising a body having a top and a bottom with a detent in the bottom;

the holder comprising:

(i) a back;

(ii) a base supporting the bottom of the container body with the container top at a higher elevation than the container bottom, the base projecting laterally from the back of the holder and having a projection for engaging the detent of the container for retaining the container in the holder; and (iii) a top vertically spaced apart and above the base and projecting laterally from the back of the holder for engaging the container top.

26. The holder of claim 25 wherein the holder top has a hole therethrough through which the container top extends.

27. The holder of claim 25 wherein the holder top has an aperture closed around its periphery so a portion of the container body can pass transversely through the aperture.

28. A holder for a pumpable dispensing container, the dispensing container comprising: (i) a body having a bottom and a top, and (ii) a pumpable dispensing mechanism at the top;

the holder comprising:

(i) a back;

(ii) a base for supporting the bottom of the container body with the container top at a higher elevation than the container bottom, the base projecting laterally from the back of the holder, wherein the holder base is skewed relative to the plane of the holder back a sufficient amount that the container top is farther away from the back than is the container bottom when the back is vertical; and (iii) a top vertically spaced apart and above the base and projecting laterally from the back of the holder, the top of the holder having an aperture enclosed around its periphery and sized so that a portion of the container body can pass transversely through the plane of the aperture, such that the holder does not interfere with the pumping of the dispensing mechanism and sufficiently supports the container so that the dispensing mechanism can be pumped, and wherein the container bottom and the holder base each has a plurality of surfaces for maintaining the container bottom and the holder base in contact with each other.

29. The holder of claim 28, wherein the holder top has an aperture enclosed around its periphery through which the container top can project.

* * * * *